United States Patent [19]

Raes

[11] Patent Number: 4,636,652

[45] Date of Patent: Jan. 13, 1987

[54] ELECTRIC CIRCUIT CONTROL DEVICE

[75] Inventor: Marc Raes, Lamorlaye, France

[73] Assignee: Compagnie Industrielle des Telecommunications Citalcatel, France

[21] Appl. No.: 746,424

[22] Filed: Jun. 19, 1985

[30] Foreign Application Priority Data

Jun. 20, 1984 [FR] France ..... 84 09673

[51] Int. Cl.[4] ..... H01H 43/06

[52] U.S. Cl. ..... 307/141; 307/140; 315/227 R

[58] Field of Search ..... 307/113, 115, 123, 140, 307/141, 141.4, 141.8, 125, 132 E, 134, 135, 154; 315/227 R, DIG. 5, DIG. 7; 361/166, 195

[56] References Cited

U.S. PATENT DOCUMENTS

| | | | |
|---|---|---|---|
| 3,814,950 | 6/1974 | Adams | 307/141 |
| 3,940,660 | 2/1976 | Edwards | 307/141 X |
| 4,204,128 | 5/1980 | Kruper | 307/141 |
| 4,339,693 | 7/1982 | DeBijl et al. | 315/227 R X |
| 4,426,639 | 1/1984 | Jessup | 307/141 X |
| 4,507,569 | 3/1985 | Hess, II | 307/140 X |
| 4,536,693 | 8/1985 | Marek | 307/140 X |

*Primary Examiner*—William M. Shoop, Jr.
*Assistant Examiner*—Sharon D. Logan
*Attorney, Agent, or Firm*—Sughrue, Mion, Zinn, Macpeak, and Seas

[57] ABSTRACT

An electronic control device enables a load to be separated from a power supply network for a time corresponding to the period which the load would cause a major disturbance in the network due to the state of the load at the time of a temporary main outage. The electric circuit control device comprises a first, normally open controlled switch (2) connected in the electric circuit, a second, normally closed, controlled switch (4) shunted with the first controlled switch (2), a power supply network (6) for supplying power to the control device, first time delay control network (17) connected to the first controlled switch (2), second time delay control network (30) connected to the second controlled switch (4) and memory network (41) connected to the second controlled switch (4), the time delay of the first control network (17) being at most equal to the time delay of the second control network (30).

5 Claims, 1 Drawing Figure

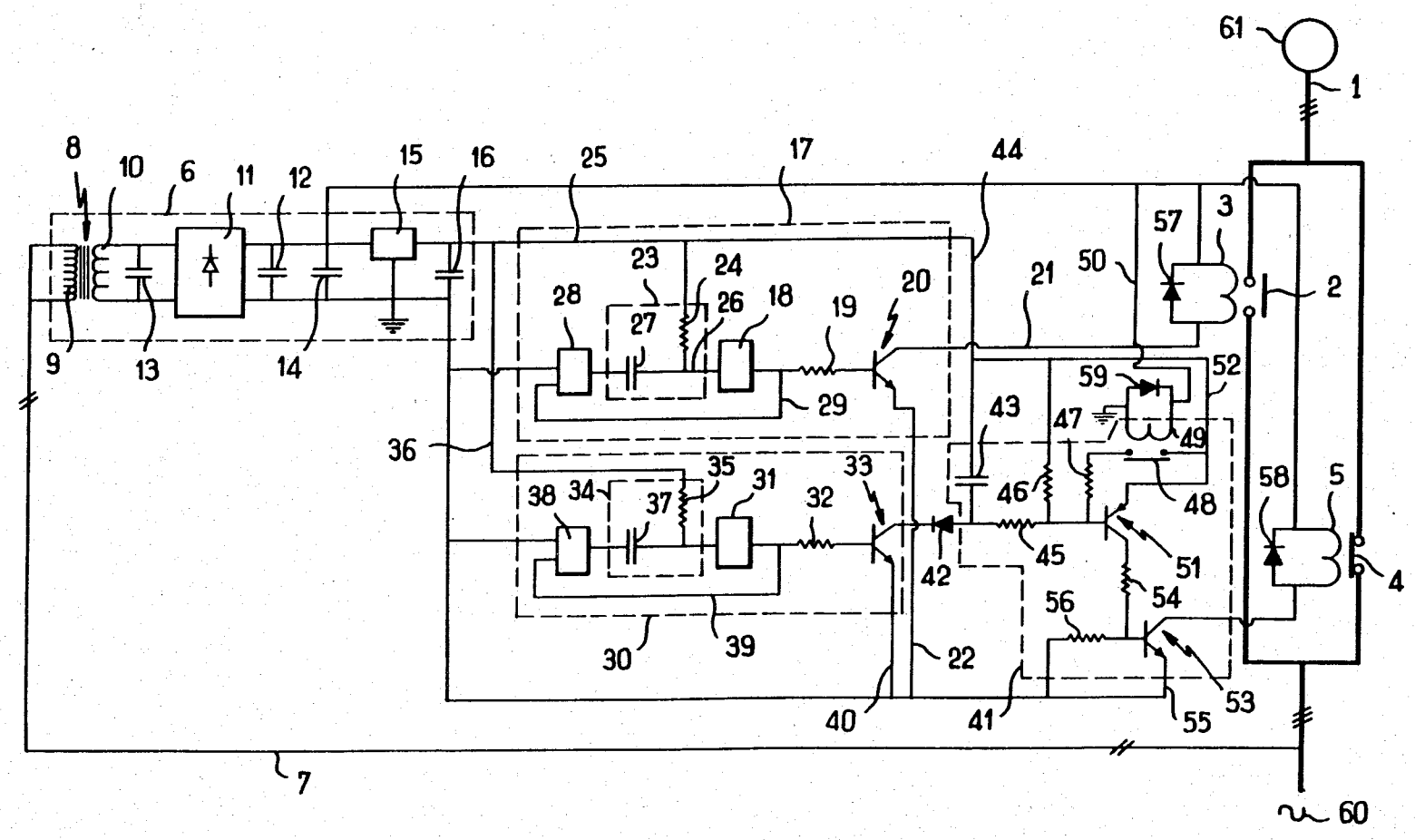
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61

ELECTRIC CIRCUIT CONTROL DEVICE

BACKGROUND OF THE INVENTION

1. Field of the Invention

This invention concerns a control device for an electric circuit.

2. Description of the Prior Art

Electrical apparatus are known to generally affect the operating conditions of the circuit to which they are connected. In particular, it is known that high inductance devices such as lamps cause a lead which, in order to avoid disturbances in the power supply network, must be offset by suitable lag-inducing elements, such as by one or more capacitors connected to the device's terminals.

In some cases, the device's effect on the supply circuit varies according to the operating conditions of the device itself. Thus, in the case of a discharge lamp, inductance is high only when the lamp is lighted. Consequently, as long as the lamp is unlighted, the reactive power provided by the capacitor is not compensated, resulting in disturbances in the network whenever the discharge lamp is connected to the network but not lighted.

Moreover, a discharge lamp will not light unless the gases contained therein have cooled. Accordingly, in the event of a temporary mains outage, discharge lamps go out and cannot come back on for a certain lapse of time during which the capacitors create a disturbance in the network. Obviously, in the case of public lighting systems where a large number of discharge lamps are connected to a common supply line, a brief outage causing the lamps to be extinguished subsequently causes a major disturbance which must be compensated by boosting the power supplied to the network. Otherwise, the reactive power of the capacitors is not compensated and the discharge lamps cannot relight.

SUMMARY OF THE INVENTION

It is therefore an object of the present invention to propose an electric circuit control device enabling an apparatus to be separated from the network for a time corresponding to the period during which the apparatus would cause a major disturbance in the network due to its state at the time of the interruption.

The invention accordingly provides an electric circuit control device characterized in that it comprises a first, normally open, controlled switch connected in the electric circuit, a second, normally closed, controlled switch, shunted with the first controlled switch, means for supplying power to the control device, said means connected in the electric circuit upstream from said first and second controlled switches, first time delay control means connected to said first controlled switch, second time delay control means connected to said second controlled switch and memory means connected to said second controlled switch, the time delay of the first control means being at most equal to the time delay of the second control means.

Thus, as a network outage occurs, the first controlled switch returns to its open, rest position, whereas the second controlled switch is kept open by the memory means and the apparatus is thus separated from the network as long as the memory means have not been cleared to zero.

BRIEF DESCRIPTION OF THE DRAWING

The sole FIGURE is a schematic diagram of a preferred embodiment of the present invention.

DETAILED DESCRIPTION OF A PREFERRED EMBODIMENT

In one advantageous embodiment of the invention, the memory means consist of a capacitor associated with at least one resistor, parallel-connected to the capacitor's terminals. Thus, when the network supply is cut off, the capacitor gradually discharges into the resistor and the memory means automatically return to zero, after a delay determined by the capacitor's characteristics.

According to a preferred embodiment of the invention, the memory means comprise at least a second resistor connected in parallel with the first in series with a third, normally open, controlled switch the control thereof being connected to the supply means. Thus, when the circuit is re-powered, the second resistor speeds the capacitor's discharge, which compensates the slowing of said discharge caused by the repowering of the device.

Another feature of the preferred of the invention is that at least one of the control means of the first and second controlled switches comprises at least a first flip-flop the output whereof is connected to the corresponding switch, time delay means arranged between the supply means and the first flip-flop and means for holding the control means in an activated position. Thus, the control means are automatically maintained in their normal operating position as long as no outage has occurred in the network.

A further feature of the preferred embodiment is that the time delay means comprise a resistor one terminal whereof is connected to the supply means and the other terminal whereof is connected on the one hand to the input of the first corresponding flip-flop and on the other hand to a first terminal of a capacitor, and the holding means comprise a second flip-flop having one input connected to the output of the first flip-flop and its output connected to a second terminal of the capacitor opposite the first. Thus, the time during which the controlled switch remains de-energized corresponds to the time required to charge the capacitor through the resistor, such that the first flip-flop is only activated after a set amount of time and then is automatically kept activated by the second flip-flop.

Other features and advantages of the invention will follow from the description hereinafter of a non-limiting example made with reference to the single appended FIGURE schematically illustrating the circuit of this embodiment.

Referring to the FIGURE, the control device for an electric circuit 1 comprises a first, normally open at rest, switch 2 controlled by a coil 3 and connected into the electric circuit 1, a second, normally closed, switch 4, shunt connected to the first switch 2 and controlled by a coil 5.

Power supply means 6 for the control device are connected to the electric circuit 1 upstream from the first and second controlled switches 2, 4 by a line 7.

The control device power supply means 6 comprise a transformer 8 with primary winding 9 and secondary winding 10, a diode bridge 11 connected between the terminals of the secondary winding 10, a smoothing capacitor 12, noise absorption capacitors 13 and 14, a voltage regulator 15 and a second smoothing capacitor 16.

Coils 3 and 5 are connected in parallel by a common line to the power supply means 6, upstream from the voltage regulator 15.

First time delay control means 17 are arranged between the power supply means 6 and the control coil 3 of the first controlled switch 2. First time delay control means 17 include a first flip-flop 18 whose output is connected to the coil 3 of the first controlled switch 2 through an intervening resistor 19 connected to the base of a NPN transistor 20 the collector whereof is connected to the terminal of coil 3 opposite the coil 3 terminal connected to the supply means 6 through a line 21; the emitter of transistor 20 is grounded through a line 22. Time delay means 23 consist of a resistor 24 one of whose terminals is connected to supply means 6 by a line 25, whilst the other terminal is connected to the input of the flip-flop 18 by a line 26. Time delay means 23 further comprise a capacitor 27 one of whose terminals is also connected to line 26, and whose other terminal is grounded via means for holding the control means in an activated position. These holding means consist of a second flip-flop 28 one of whose inputs is connected directly to ground and the other of whose inputs is connected via a line 29 to the output of the first flip-flop 18, the output of flip-flop 28 being connected to the terminal of capacitor 27 opposite said capacitor's terminal connected to the input of flip-flop 28.

Second time delay control means, similarly to first time delay control means 17 comprise a flip-flop 31, connected through a resistor 32 to a NPN transistor 33. Time delay means 34 comprise a resistor 35 one of the terminals whereof is connected to supply means 6 by a line 36 and the other to the input of flip-flop 31. Time delay means 34 further include a capacitor 37 having a first terminal connected to the input of flip-flop 31 and its opposite terminal connected to the output of a flip-flop 38 forming means for holding the control means 30 in an activated position. Just as flip-flop 28, flip-flop 38 has one input terminal connected to ground and the other connected to the output of the first flip-flop 31 via a line 39.

The emitter of transistor 33 is connected to ground via a line 40 and the collector thereof is connected to memory means 41 via a decoupling diode 42. Memory means 41 comprise a capacitor 43 having one terminal connected to the supply means 6 via a line 44 and associated with a resistor 46, connected in parallel with the capacitor terminals through a resistor 45.

Memory means 41 moreover comprise a second resistor 47, parallel-connected with the first 46 and series-connected with a normally open switch 48 controlled by a coil 49 one of whose terminals is connected to supply means 6 via a line 50 and whose other terminal is grounded.

The signal from the memory means is amplified by a PNP transistor 51, the base whereof is connected to one of the common terminals of resistors 46 and 47, the emitter whereof is connected to supply means 6 via a line 52 and the collector whereof is connected to the base of a NPN transistor 53 via a resistor 54. Transistor 53's collector is connected to the terminal of coil 5 opposite the coil terminal connected to supply means 6. It's emitter is grounded via a line 55 and its base is also grounded, via a resistor 56.

Diodes 57, 58 and 59 are respectively parallel-connected to coils 3, 5 and 49 in order to protect the transistors against self-induction in these coils when their current is cut off.

Assuming the electric circuit 1 to be connected upstream to an alternating current power source 60, and connected downstream to an electrical apparatus such as a discharge lamp, for example, the operation of the control device is as follows: on connection with the AC source 60, switch 4 is closed and current can flow normally to the load, for example to a discharge lamp 61, which is cold and thus instantly lights up.

Meanwhile, flip-flop 18 is at rest and transistor 20 is therefore off. Thus, coil 3 is not energized and switch 2 is open.

Flip-flop 31 is also at rest so that transistor 33 is off. Consequently, no current is present at the base of transistor 51, which is also off, as is transistor 53. Coil 5 is thus not excited and switch 4 remains temporarily closed.

In these conditions, capacitors 27 and 37 are supplied by supply means 6, through resistors 24 and 35 respectively. Resistors 24 and 35 have a high value and thus bring about a substantial voltage drop which keeps the respective flip-flops 18 and 31 de-energized as long as capacitors 27 and 37 are not fully charged.

As soon as capacitor 27 becomes charged, the rated voltage is fed to flip-flop 18, which switches so that current can flow into the base of transistor 20, which then conducts. Coil 3 then becomes excited and switch 2 closes. Apparatus 61 is thus supplied in parallel by switches 2 and 4. Moreover, the output signal of flip-flop 18 is transmitted along line 29 to flip-flop 28, exciting the latter to hold capacitor 27 in charged state and thus flip-flop 18 in its energized state. Set of flip-flops 18 and 28 thus remains energized and switch 2 remains closed as long as no interruption occurs in the network.

Similarly, as soon as capacitor 37 becomes charged, flip-flop 31 switches and transistor 33 conducts. Consequently, transistor 51 also conducts, causing transistor 53 to conduct, and coil 5 becomes energized and causes switch 4 to open. It is immediately apparent that to prevent cutting off the supply to apparatus 61, the time delay established by time delay means 23 must be at most equal to the time delay established by time delay means 34, so that the first controlled switch 2 closes, at the latest, at the time when the second controlled switch 4 opens.

During a power supply interruption from AC source 60, coils 3 and 5 cease to be excited and switches 2 and 4 resume their rest positions. At the same time, capacitors 27 and 37 discharge almost instantly and flip-flops 18 and 31 reset. Capacitor 43, which has charged through transistor 33 during the previous supply period, keeps transistor 51 conducting and gradually discharges through resistors 45, 46.

If current again flows through the network 60 before capacitor 43 has discharged, flip-flop 18 stays in the rest state pending the recharging of capacitor 27 and switch 2 thus remains open during this time. Conversely, transistors 51 and 53 are kept conducting by the discharging of capacitor 43 and coil 5 is thus excited, causing switch 4 to open. As a consequence, as long as capacitor 43 has not discharged, apparatus 61 is disconnected from the network. In the case of a discharge lamp, capacitor 43 is selected to have a discharge time equal to the lamp cooling time, such that lamp 61 can light instantly when switch 4 recloses and not cause a network disturbance.

As current flows again in the network following an outage, the power supply voltage carried by line 44 brings about a slowing of the discharge rate of capacitor 43. This slowing of discharge is offset by the switching in of resistor 47 by the closing of switch 48 due to the energizing of coil 49.

If current flow is re-established after a sustained outage lasting longer than the discharge time of capacitor 43, transistors 51 and 53 go off and coil 5 is therefore not excited. Consequently, switch 4 remains closed and the load apparatus 61 is thus immediately supplied, and in the case of a discharge lamp, the latter lights instantly without disturbing the network. Subsequent operation then proceeds exactly as described hereinabove concerning first power-up.

According to one particular embodiment of the invention, flip-flops 18 and 31 are OR gates each having their two inputs connected respectively to resistors 24 and 35, flip-flips 28 and 38 are also OR gates, the supply voltage at the output of voltage regulator 15 is 12 volts, capacitors 27 and 37 have a capacitance of 100 microfarads, resistor 24 has a value of 560 kilo-ohms and together with capacitor 27 establishes a time delay of roughly 3 minutes, resistor 35 has a value of 600 kilo-ohms and together with capacitor 37 establishes a time delay of 3 minutes and a few seconds, capacitor 43 has a value of 1,000 microfarads, resistor 46 has a value of 620 kilo-ohms, resistor 47 has a value of 75 kilo-ohms and resistor 20 a value of 39 kilo-ohms.

It should be understood that the invention is not limited to the embodiment described in the foregoing and that different implementations may be made thereof.

Thus, although the invention has been described in terms of analog means, it could be implemented in the same way using digital means.

It may also be pointed out that the time delay control means 17 and 30 have substantially the same configuration and accordingly, without departing from the scope of the invention, control means 17 can be eliminated and line 21 connected directly to the collector of transistor 33, making the first and second control means common. In this case, the initial time delay is the same on excitation of coil 3 and coil 5, and switches 2 and 4 switch simultaneously. Such an approach however introduces a risk of disturbance, especially if switch 2 has an inertia slightly greater than that of switch 4. As such, switch 4 would open before the closing of switch 2, bringing about a momentary interruption of supply to load apparatus 61 and the risk of a new extinction.

Although the invention has been described specifically in relation to discharge lamps, it can be applied to other apparatus.

What is claimed is:

1. Electric circuit control device comprising a first, normally open, controlled switch connected in the electric circuit, a second, normally closed, controlled switch shunted with the first controlled switch, means for supplying power to the control device, said means connected in the electric circuit upstream from said first and second controlled switches, first time delay control means connected to said first controlled switch, second time delay control means connected to said second controlled switch and memory means connected to said second controlled switch, the time delay of the first control means being at most equal to the time delay of the second control means.

2. Device according to claim 1, wherein said memory means comprise a capacitor associated with at least one resistor parallel-connected to the terminals of the capacitor.

3. Device according to claim 2, wherein said memory means comprise at least a second resistor parallel-connected to the first resistor and series-connected to the first normally-open, controlled switch, the control whereof is connected to the power supply means.

4. Device according to claims 1 through 3, wherein at least one of the control means of the first and the second controlled switches comprises at least a first flip-flop whose output is connected to the corresponding switch of the time delay means arranged between the power supply means and the first flip-flop and holding means for holding the control means in an activated position.

5. Device according to claim 4, wherein the time delay means include a resistor one of whose terminals is connected to the supply means and whose other terminal is connected on the one hand to the input of the corresponding first flip-flop and on the other hand to a first terminal of the capacitor and wherein the holding means include a second flip-flop one of the inputs whereof is connected to the output of the first flip-flop and the output whereof is connected to a second terminal of the capacitor, opposite the first.

* * * * *